US008980063B2

(12) United States Patent
Kim et al.

(10) Patent No.: US 8,980,063 B2
(45) Date of Patent: Mar. 17, 2015

(54) AIR PROPORTIONING SYSTEM FOR SECONDARY AIR IN COKE OVENS DEPENDING ON THE VAULT VS. SOLE TEMPERATURE RATIO

(75) Inventors: Ronald Kim, Essen (DE); Alfred Mertens, Essen (DE)

(73) Assignee: Uhde GmbH, Dortmund (DE)

( * ) Notice: Subject to any disclaimer, the term of this patent is extended or adjusted under 35 U.S.C. 154(b) by 929 days.

(21) Appl. No.: 12/998,222

(22) PCT Filed: Aug. 25, 2009

(86) PCT No.: PCT/EP2009/006137

§ 371 (c)(1),
(2), (4) Date: Apr. 25, 2011

(87) PCT Pub. No.: WO2010/034383

PCT Pub. Date: Apr. 1, 2010

(65) Prior Publication Data

US 2011/0198206 A1 Aug. 18, 2011

(30) Foreign Application Priority Data

Sep. 29, 2008 (DE) ..... 10 2008 049 316

(51) Int. Cl.

| | |
|---|---|
| ***C10B 5/06*** | (2006.01) |
| ***C10B 15/02*** | (2006.01) |
| ***C10B 21/22*** | (2006.01) |
| ***C10B 21/10*** | (2006.01) |
| ***C10B 41/00*** | (2006.01) |

(52) U.S. Cl.

CPC ..... *C10B 15/02* (2013.01); *C10B 21/22* (2013.01); *C10B 5/06* (2013.01); *C10B 21/10* (2013.01); *C10B 41/00* (2013.01)

USPC ..... 201/15; 201/37; 201/41; 202/135; 202/137; 202/145; 202/151; 202/215; 202/262; 202/269

(58) Field of Classification Search

CPC ..... C10B 5/06; C10B 15/02; C10B 21/10; C10B 21/22; C10B 41/00

USPC ..... 201/1, 15, 37, 41; 202/99, 135, 137, 202/145, 151, 215, 262, 269

See application file for complete search history.

(56) References Cited

U.S. PATENT DOCUMENTS

| | | | | | |
|---|---|---|---|---|---|
| 3,963,582 | A | * | 6/1976 | Helm et al. | 201/2 |
| 4,111,757 | A | * | 9/1978 | Ciarimboli | 202/93 |
| 4,124,450 | A | * | 11/1978 | MacDonald | 201/15 |

(Continued)

FOREIGN PATENT DOCUMENTS

| | | | |
|---|---|---|---|
| DE | 10 2006 004 669 | A1 | 8/2007 |
| WO | WO 2007/057076 | A1 | 5/2007 |
| WO | WO 2007/087839 | A1 | 8/2007 |

*Primary Examiner* — Prem C Singh
*Assistant Examiner* — Jonathan Miller
(74) *Attorney, Agent, or Firm* — Marshall & Melhorn, LLC

(57) ABSTRACT

A device for proportioning of secondary combustion air into the secondary air soles of coke oven chamber ovens is shown. The device is formed by a slide gate or a parallelepiped device or by plates moved by means of a thrust bar, the thrust bar being moved longitudinally in parallel to the coke oven chamber wall so that the plates move away from the secondary air apertures and open or close these. The thrust bar is moved by means of a positioning motor, with the power transmission being effected hydraulically or pneumatically. Via suitable measuring parameters, it is thus possible to optimize secondary heating so that heating is provided evenly from all sides, thus achieving an improvement in coke quality.

21 Claims, 5 Drawing Sheets

(56) References Cited

U.S. PATENT DOCUMENTS

| | | | | |
|---|---|---|---|---|
| 4,287,024 | A | 9/1981 | Thompson | |
| 4,344,820 | A | 8/1982 | Thompson | |
| 6,017,214 | A * | 1/2000 | Sturgulewski | 432/247 |
| 6,187,148 | B1 * | 2/2001 | Sturgulewski | 202/258 |
| 2009/0032382 | A1 | 2/2009 | Schuecker et al. | |
| 2010/0025217 | A1 * | 2/2010 | Schuecker et al. | 201/15 |
| 2011/0048917 | A1 * | 3/2011 | Kim et al. | 201/27 |

* cited by examiner

AIR PROPORTIONING SYSTEM FOR SECONDARY AIR IN COKE OVENS DEPENDING ON THE VAULT VS. SOLE TEMPERATURE RATIO

BACKGROUND OF THE INVENTION

The invention relates to a device for controlling the quantity of secondary combustion air in coke oven chambers of a coke oven battery of the "Heat-Recovery" or "Non-Recovery" type, wherein this device regulates the air volume through a parallelepiped attachment or a plate driven by a positioning motor so that this device can be regulated, for example, via a control mechanism which depends on measuring values in a coke oven chamber. Heating of a coke cake of a coke oven battery can be substantially homogenized and improved via the secondary heating space located under the coke cake. The quantity of secondary air can be supplied by the inventive device in several quantity graduations, if required. A supply of secondary air in multiple stages allows for reducing the quantity of formed nitric oxides substantially. The present invention also relates to a method for proportioning of secondary combustion air in a coke oven chamber.

Based on prior art in technology, the heating of coke oven chambers is so executed that the heating of a coke cake is performed as evenly as possible from all sides and that the quality of coke thus obtained is improved in this manner. For coal carbonization, the pre-warmed coking chamber of the coke oven is charged with a coal layer and then closed. The coal layer can be provided as a top-filled coal batch or in compacted, stamped form. By warming the coal, volatile matter contained in coal, above all hydrocarbons and hydrogen, is given off and expelled. Further heat generation in the coking chamber of "Non-Recovery" coke ovens and "Heat-Recovery" coke ovens is exclusively effected by combustion of released coal volatile matter constituents which degas successively as heating advances.

According to prior art in technology, combustion is so controlled that part of the gas released which is also designated as crude gas is burnt directly above the coal charge in the coking chamber. Combustion air needed for this purpose is sucked in through apertures in the doors or ceiling or through apertures in the doors and in the ceiling. This combustion stage is also designated as the first air stage or primary air stage. The primary air stage usually does not lead to complete combustion. Heat released on combustion heats the coal layer, with an ash layer forming on its surface after a short period of time. This ash layer provides for sealing towards air and in the further course of the coal carbonization process, it prevents a burn-off of the coal layer. Part of the heat released on combustion is predominantly transferred by radiation into the coal layer. A mere heating of the coal layer from the top by applying only one air stage, however, would lead to uneconomically long coking times.

Crude gas partly burnt in the primary air stage is therefore burnt at another stage, with the heat thus evolving being supplied to the coal layer from the bottom or from the side. This post-combustion designated as secondary combustion usually occurs in so-called secondary heating spaces located underneath the coke oven chamber and underneath the coke cake, so that partly burnt coking gas completely burns-out there, while the heat of combustion evolving there heats the coke cake from below. Thereby the heat distribution of the coke cake is substantially homogenized from all sides and the quality of coke produced is noticeably improved. Guiding of partly burnt coking gas is usually taken charge of by so-called "downcomer" channels which for example are located in the lateral brickwork of a coke oven chamber.

According to this approach, air needed for secondary air combustion, which is called secondary air, is supplied through so-called secondary air apertures located underneath the lateral coke oven chamber doors of coke oven chambers in a typical construction style. From there, the secondary air streams into a so-called secondary air sole where the air is collected and conducted into a secondary heating chamber located above. Secondary combustion occurs there. Combustion air streaming in is generally supplied in a clearly over-stoichiometrical quantity. Thus it is ensured that the partly burnt coking gas burns-out completely, so that the heat of combustion contained therein is completely given off. In this manner, it is also intended to prevent a discharge of incompletely burnt carbonization products, e.g. hydrocarbons.

Supplied secondary air, however, has generally attained the temperature of the surrounding atmosphere, thus quite substantially reducing the temperature of the secondary air sole and secondary heating space underneath the coke cake. By a non-controlled supply of secondary combustion air into the secondary heating space, the temperature of the secondary heating space cannot be controlled, so that the temperature of the secondary heating space may clearly differ from the temperature in the primary heating space, which is also designated as coke oven vault. As a result, the heating of coke from different sides is uneven. Moreover, the quantity of supplied secondary air cannot be regulated depending on the amount of oxygen in the secondary heating space. This may entail a formation of pollutants, but more particularly a formation of non-burnt hydrocarbons or nitric oxides of the $NO_x$ type.

WO 2007/057076 A1 describes a ventilating device for the supply of primary and secondary air for the combustion of coking gas from coke ovens built in flat construction style and arranged as a battery, said ventilating device being comprised of at least one venting aperture per coking chamber for the primary air, said venting aperture extending through the relevant coke oven door or through its framing wall, and furthermore comprised of at least one venting aperture per coking chamber for the secondary air and movably supported closure elements being provided at least for a part of the venting apertures, wherein according to the invention at least a part of said closure elements of the venting apertures is mechanically connected to a positioning element which is controlled and driven from a central position, and wherein the closure elements are to be actuated by means of the positioning element depending on the demand for combustion air, with it being possible to establish the mechanical connection of each closure element to the central positioning element individually; in particular it is possible to effect the starting position of each individual closure element at the beginning of the carbonization cycle of the associated coking chamber separately and independently of the other closure elements of the neighboring coking chambers. Embodiments lay claim to the closure elements, positioning elements, and to the method.

The procedure is not automatized and frequently it is controlled by temperature-sensitive chains extending around a coke oven. Prior art devices frequently comprise positioning elements or closure elements which yield only a limited service life if exposed to high temperatures of coke ovens.

BRIEF SUMMARY OF THE INVENTION

Now, therefore, it is the object to provide a device that controls the quantity of secondary air into the ventilating apertures for secondary air. The device is to be mounted preferably beneath coke oven chamber doors of a coke oven chamber, because in a frequently encountered construction type the apertures for ventilating the secondary air soles are located beneath the coke oven chamber doors. Moreover, the device is to be made of a high-temperature stable material in order to have a sufficiently long service life at these high temperatures which usually prevail at the external walls of coke oven chambers. The device should also be able to open or close the apertures for ventilating the secondary air soles completely and it should be insensitive to contamination and weathering impacts.

It should also be possible to automatize the inventive device so that the proportioning quantity of secondary air can be controlled depending on the content of oxygen in the secondary heating space or depending on the temperature in the coke oven vault.

The present invention solves this task by way of an air proportioning system for secondary air in coke ovens that can be controlled depending on the ratio between vault and sole temperature and that closes the ventilating apertures for secondary air by parallelepiped covers. The parallelepiped elements are so configured that a connecting web or a connecting rod linked to a thrust bar can be affixed thereto so that the parallelepiped elements are traversed by this thrust bar along the coke oven chamber wall. By way of this longitudinal movement, the ventilating apertures can be entirely closed, partly closed or entirely opened so that these parallelepiped elements in combination with the thrust bar take the effect of an air proportioning system.

The thrust bar and the parallelepiped attachments are preferably made of a high-temperature resistant steel so that the entire device provides for a long service life if exposed to prevailing temperatures. In an embodiment of the present patent, the parallelepiped attachment may be configured as a plate.

Claim is also laid to a device for controlling the quantity of secondary combustion air in a coke oven of a coke oven battery or a coke oven bank of the "Non-Recovery" or "Heat Recovery" type, wherein secondary combustion air enters through apertures in the pusher side or coke side frontal coke oven chamber wall beneath the coke oven chamber door into channels which lie beneath the coking chamber and where partly burnt coking gas is mixed with secondary combustion air and burnt completely, so that the coke cake is heated from below by the combustion of partly burnt coking gas, and which is characterized in that the apertures on their front side are provided with parallelepiped attachments which on the cuboid side averted from the oven are linked to a second smaller cuboid, and a con-rod or a connecting web through which the rear-side smaller cuboid is linked to a thrust bar is mounted on the upper side of the smaller cuboid, and the thrust bar can be traversed through a positioning motor or manually in parallel to the frontal coke oven chamber wall, and the thrust bar whilst moved longitudinally along the coke oven chamber wall moves the parallelepiped attachments by the longitudinal movement along the apertures so that these open or close the apertures depending on the position of the parallelepiped attachments.

As an example, the parallelepiped device may be a plate. But it may also be a red brick or a metal block. For execution of the inventive device, the parallelepiped device is advantageously provided with another parallelepiped attachment, with the front-end cuboid being so connected to the rear-side cuboid that it tapers towards the rear-side cuboid. On the one hand, this reduces the amount of pollution, but on the other hand, it also allows for a mechanical connection to the thrust bar. As an example, the mechanical connection may be implemented by connecting webs or con-rods. This ensures good strength for exerted mechanical forces.

In an advantageous embodiment of the present patent, the front-end parallelepiped attachment is a plate. In another advantageous embodiment, both the front-end parallelepiped attachment, the tapering as well as the rear-end parallelepiped attachment are made of a high-temperature resistant steel. In case the front-end parallelepiped attachment is a plate, then it is also preferably made of high-temperature resistant steel. In case the front-end cuboid facing the oven is executed as a plate, then the tapering may be very narrow or be omitted. In an exemplary embodiment, the connections of the parallelepiped attachments, the link to the connecting webs and the link to the thrust bar may be implemented by welded joints. The thrust bar with the connecting webs may be guided both beneath the secondary air apertures and above the secondary air apertures.

In another advantageous embodiment, the thrust bar is linked via cardan joints to the con-rods or connecting webs and thus to the positioning motor. Transpositions or mechanical stresses of the thrust bar can thus be better compensated.

In a simple embodiment of the present patent, the positioning motor may be comprised of an electric positioning motor. In a preferred embodiment, it is comprised of a pressure cylinder that can be charged under pressure with a gas or a liquid and be released from pressure. The pressure cylinder comprises a drive piston which is linked to the thrust bar and which is driven by a gas or a liquid because of the pressure charging and discharging. The positioning motor then comprises pumps and valves. The positioning motor and the drive device may also comprise protective shields or protective mats which screen the driving device and the positioning motor from high temperatures at the coke oven chamber wall. These are preferably located on the thrust bar between the pressure cylinder and the connecting web. The protective screens may be made of any high-temperature resistant material. For example, this may be steel or a glass fiber material.

Claim is also laid to a method for proportioning of secondary combustion air into the secondary air sole of coke oven chambers of a coke oven battery or a coke oven bank, wherein the secondary combustion air enters through secondary air apertures in the pusher side or coke side frontal coke oven chamber wall in the lower area of the coke oven chamber beneath the coke oven chamber door into the secondary air sole and then streams into the secondary heating space located there above, and the coking gas partly burnt in the upper area of the coke oven chamber is completely burnt there, with the completely burnt coking gas being conducted through the entire secondary air heating space so that the coke cake is heated from the lower side, too, and the secondary air aperture is covered by a parallelepiped attachment linked via a con-rod to a thrust bar so that the parallelepiped attachment opens or closes the secondary air aperture with its front-end side at each position along the coke oven chamber longitudinal wall whilst the thrust bar is moved longitudinally along the frontal coke oven chamber so that the secondary air quantity admitted into the coking chamber sole can be proportioned, and the thrust bar can be traversed via connecting webs through a positioning motor or manually so that the secondary air quantity admitted into the coking chamber sole is proportioned as this thrust movement is made.

The method can be applied manually by simply shifting the thrust bar manually. By way of the parallelepiped devices, the secondary air apertures can be entirely closed, partly closed or entirely opened. This is done by simply shifting the cuboids. To automatize the method, the thrust bar is driven by a positioning motor. Accordingly, the positioning motor is situated at the end of the thrust bar and it may be located, for example, at the end of a coke oven battery, but also at any position in the coke oven battery or coke oven bank. In an embodiment of the present invention, power transmission is effected pneumatically, electrically, or hydraulically. In principle, however, power transmission may be effected arbitrarily.

The inventive method makes it possible to run the secondary air apertures both of one coke oven of a coke oven battery jointly and the secondary air apertures of one coke oven individually. In a preferred embodiment, the secondary air apertures of a single coke oven of a coke oven battery are controlled jointly. In another embodiment, however, the secondary air apertures of one coke oven of a coke oven battery can be controlled individually. Thereby, the temperature distribution within the secondary air sole can be much better controlled. In case the secondary air sole comprises four secondary air apertures in an exemplary embodiment, then it typically comprises for this method four pressure cylinders including the associated driving pistons, thrust bars, connecting webs and parallelepiped attachments. It is also conceivable to provide less inventive devices than secondary air apertures exist.

To control the closing and opening procedures, the thrust bar disposes of a device that allows for an optical or electrical monitoring of the position of the parallelepiped attachments. For example, this may be a light barrier. Advantageously, these are located at the thrust bar at a sufficient distance away from the secondary air apertures in order to be adequately stable to temperature impacts. But these devices may also be fastened to the connecting webs or to the parallelepiped attachments. By way of these devices, the position of the parallelepiped attachments can be indicated or monitored so that an automatic control is rendered feasible.

In a usual form of application, the secondary air apertures are dosed at both frontal sides of a coke oven chamber in this manner. But it is also feasible to control only one frontal side of a coke oven chamber according to the present invention. This may be both the front-end side, which is also designated as pusher side of a coke oven chamber, as well as the rear-end side of a coke oven chamber, which is also designated as the coke side of a coke oven chamber. The application of the inventive method is then also feasible on one side only, if there are secondary air apertures on both sides.

To optimize the temperature distribution of the coke oven chamber, a temperature measuring sensor may be accommodated in the coke oven chamber. The combustion in the secondary air sole can then be controlled via the supplied amount of air in such a manner that the temperature achieved there is approximately equal to the temperature in the coke oven chamber. Thereby the heating of coke can be homogenized from all sides, which leads to an optimization of the coking process and which noticeably improves the quality of coke produced. The temperature measuring sensors are for example arranged at the ceiling of the primary heating space, which is also called the vault of the coke oven chamber, and at the coke oven chamber wall in the secondary air soles or in the secondary heating space.

An example for an automatized method for controlling the secondary air apertures is taught by DE 102006004669 A1. It lays claim to a method for the carbonization of coal, there being one coke oven [including measuring device, computer unit and positioning devices] being applied and used which is charged with coal followed by the start of the coal carbonization process, and wherein during coal carbonization the concentration of one or more gas constituents is analysed, these data being transmitted to a computer unit, and this computer unit determining the supply of primary and/or secondary air on the basis of saved discrete values or model computations, and said computer unit selecting via control lines the control elements of shutoff devices for primary and/or secondary air and thus controlling and regulating the primary and/or secondary air. This method is exemplary applicable in combination with the inventive method for the dosed proportioning of secondary combustion air into the secondary air sole of coke oven chambers of a coke oven battery or a coke oven bank.

On applying the inventive method, the temperature in the primary heating space and in the secondary heating space usually amounts to 1000° C. to 1400° C. As a rule, the temperature in the secondary heating space strongly rises at the beginning of a coking cycle due to the starting combustion of coking gas. Accordingly, the coal is heated from below. Conversely, the temperature in the primary heating space falls due to the initiation of coal carbonization and due to the degassing of volatile matter. Not until the end of coal carbonization may the temperature in the primary heating space rise, so that the coke cake is predominantly heated from above. After a certain period of time, the temperature in the secondary heating space falls, because the quantity of degassing coking products decreases. To prevent a non-desired cooling-off of the secondary heating space, the parallelepiped attachments are closed after a certain period of time.

If the closure procedure is controlled via the ratio of temperatures in the primary and secondary heating space, it may start according to one embodiment at a difference of ±100° C. between the temperatures in the primary and secondary heating space. Ideally the closure procedure may be started at the exactly equal temperature in the primary and secondary heating space. For example, this can be effected in automated mode, e.g. in a computer-controlled manner, but also via a visual temperature check. Control is also feasible from a measuring room. If the closure procedure is controlled for time, then the closure of secondary air apertures may be initiated, for example, at a coking time of 30 to 70 percent of the estimated coking time of the entire coal carbonization cycle. The movement of the parallelepiped attachments to close the secondary air apertures may be effected gradually step by step, too, depending on requirements.

To optimize the oxygen stoichiometry needed for combustion in the secondary air sole, a Lambda probe is accommodated in the secondary air sole according to a preferred embodiment of the present invention. The movement of cuboids or slide gates is then effected by the positioning motor via a computer that regulates the position of the slide gate depending on the oxygen content in the secondary air sole. Combustion can thereby be optimized by utilizing a constantly optimal amount of oxygen. In this manner, the quantity of hydrocarbons and pollutants in the waste gas from a coke oven battery is reduced. This can also be accomplished in combination with a temperature measuring procedure.

The inventive method provides the benefit of a controlled combustion in the secondary heating space of a coke oven chamber. Control is effected via proportioning the air quantity as it enters into the secondary air sole of a coke oven chamber. By controlling the combustion, it is feasible to obtain a much more uniform adjustment in coke cake heating from the sides so that the quality of coke produced is substantially improved. However, on the other hand, the output of pollutants, too, is diminished because the optimal amount of air can always be exactly supplied without causing excessive cooling-off of the secondary heating space.

The inventive embodiment of a device for generating gases is explained in greater detail by way of five drawings, with the inventive method not being restricted to this embodiment.

DETAILED DESCRIPTION OF THE INVENTION

Figure 1:
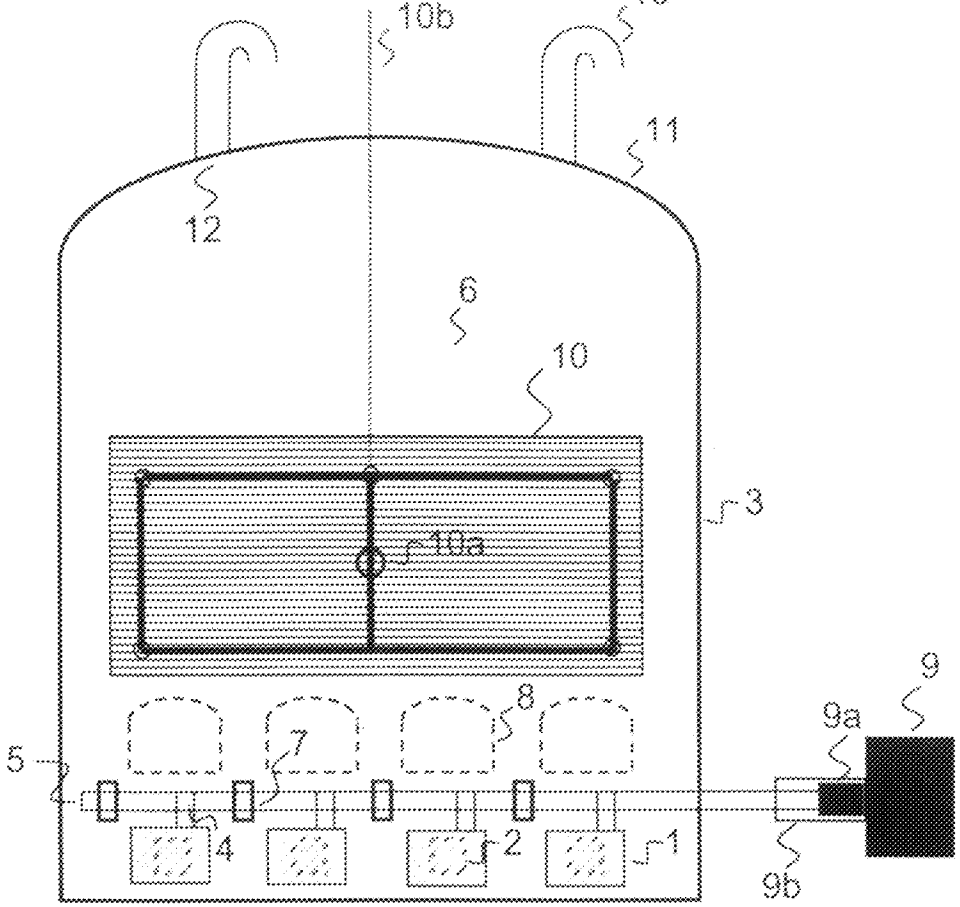
FIG. 1 shows the frontal view of a coke oven chamber with the inventive device which completely closes the secondary air apertures of a coke oven chamber.

FIG. 1 shows the inventive parallelepiped attachments (1) or plates which close the secondary air apertures (2) of a coke oven chamber (3). The parallelepiped attachments (1) are linked via connecting webs (4) to a thrust bar (5) which can be traversed in longitudinal direction to the frontal coke oven chamber wall (6). The thrust bar is retained in the appropriate position via suitable fastening devices (7). The secondary air apertures in the oven terminate in secondary heating spaces (8) where complete combustion of partly burnt coking gas occurs and which are drawn here in concealed form because they do not comprise any aperture in the frontal coke oven chamber wall (6). In this drawing, the thrust bar (5) is driven by a positioning motor (9) which is mounted at one end of the thrust bar (5). In the embodiment illustrated here, the positioning motor drives a hydraulic or pneumatic aggregate through which a drive piston (9*a*) in a pressure cylinder (9*b*) is moved. The drive piston (9*a*) is linked to the thrust bar which is driven by the movement of the drive piston (9*a*). To be seen above the secondary air apertures (2) is the coke oven chamber door (10) which is encompassed by the frontal coke oven chamber wall (6). The coke oven chamber door (10) can be pulled and opened by means of a suitable holding device (10*a*) and a coke oven chamber door hoisting device (10*b*), e.g. a chain. To be seen on the top of a coke oven chamber (11) are the entry apertures (12) for primary air which are provided with U-tube shaped covers (13) here.

Figure 2:
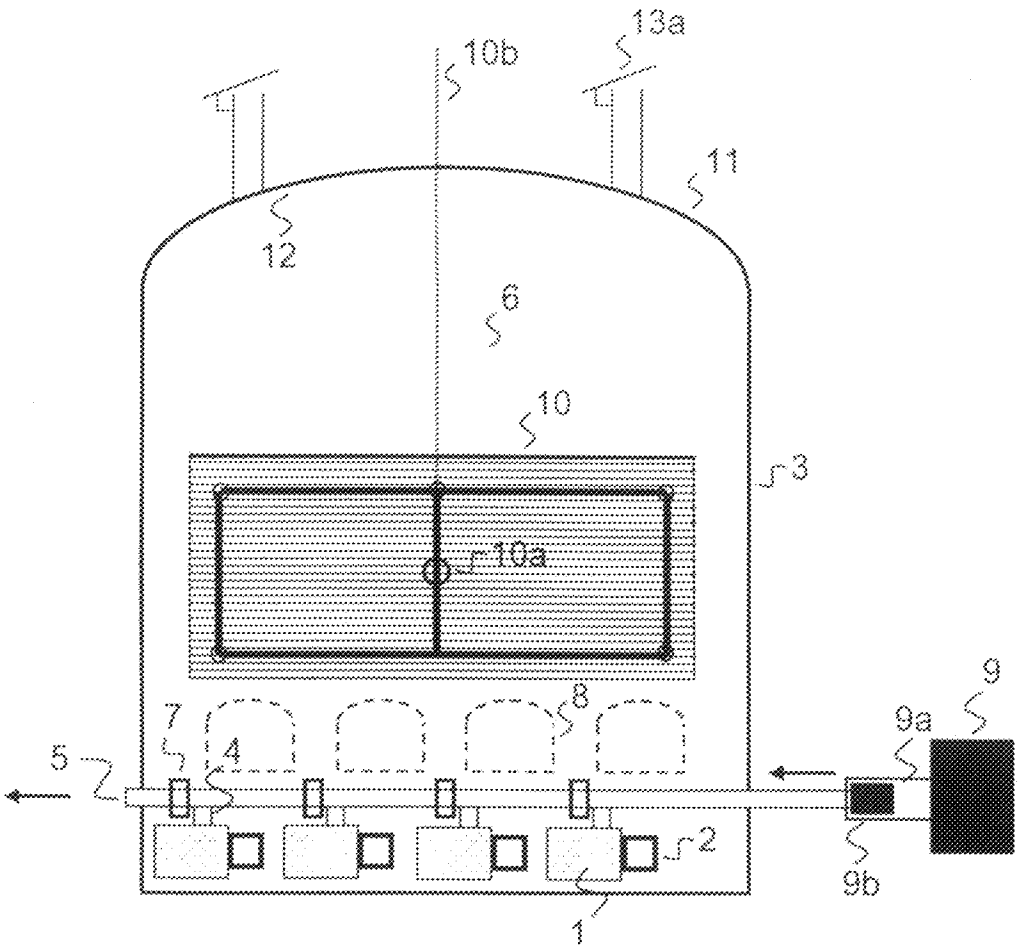
FIG. 2 shows the frontal view of the inventive device which completely opens the secondary air apertures of a coke oven chamber.

FIG. 2 shows the inventive parallelepiped attachments (1) or plates which releases and thus completely opens the secondary air apertures (2) of a coke oven chamber (3). The positioning motor (13) moves the thrust bar via an hydraulic or pneumatic aggregate (9*a*, 9*b*) laterally so that the parallelepiped attachments (1) as shown here traverse to the left and open the secondary air apertures (2). On the entry apertures for primary air (12) on the coke oven top, the coke oven batteries shown here are protected by tubes and cover flaps (13*a*) against weathering impacts.

Figure 3:
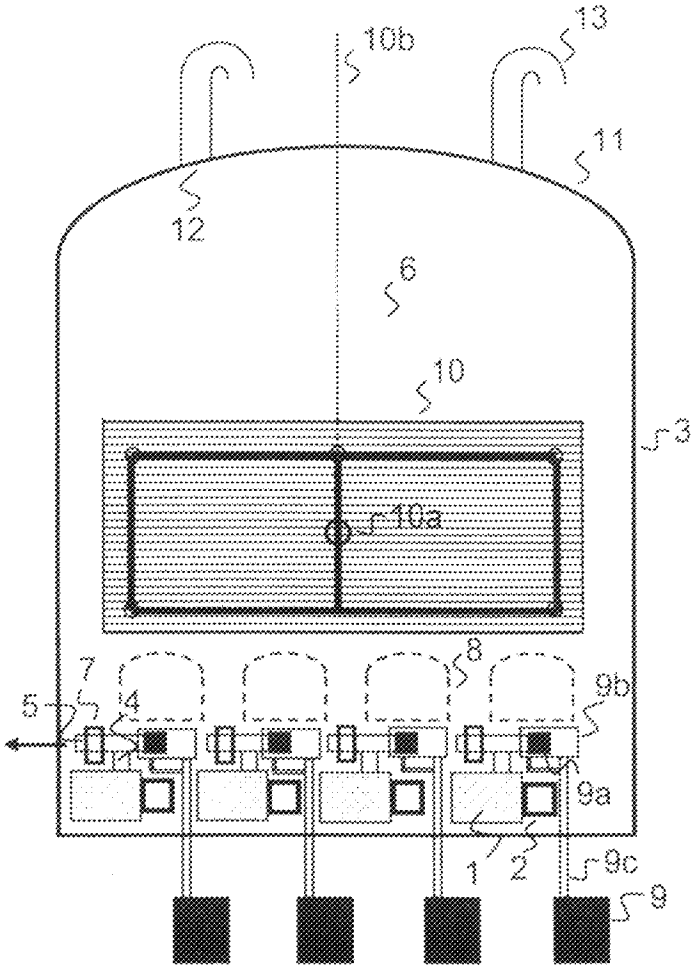
FIG. 3 shows the frontal view of a coke oven chamber with the inventive device, said coke oven chamber comprising four individually controllable secondary air apertures.

FIG. 3 shows the inventive device which individually moves and thus opens or closes the secondary air apertures at a coke oven. In this embodiment, the coke oven chamber comprises four secondary air apertures beneath the coke oven chamber door, there being one separate opening or closing mechanism with a parallelepiped attachment provided for each aperture. Each individual parallelepiped attachment is driven via a positioning motor that is moved via its own hydraulic or pneumatic main (9*c*) Since there are four secondary air apertures (2) in this embodiment, four positioning motors (9) and pneumatic mains (9*c*) with driving pistons (9*a*) and pressure cylinders (9*b*) are also provided for.

Figure 4:
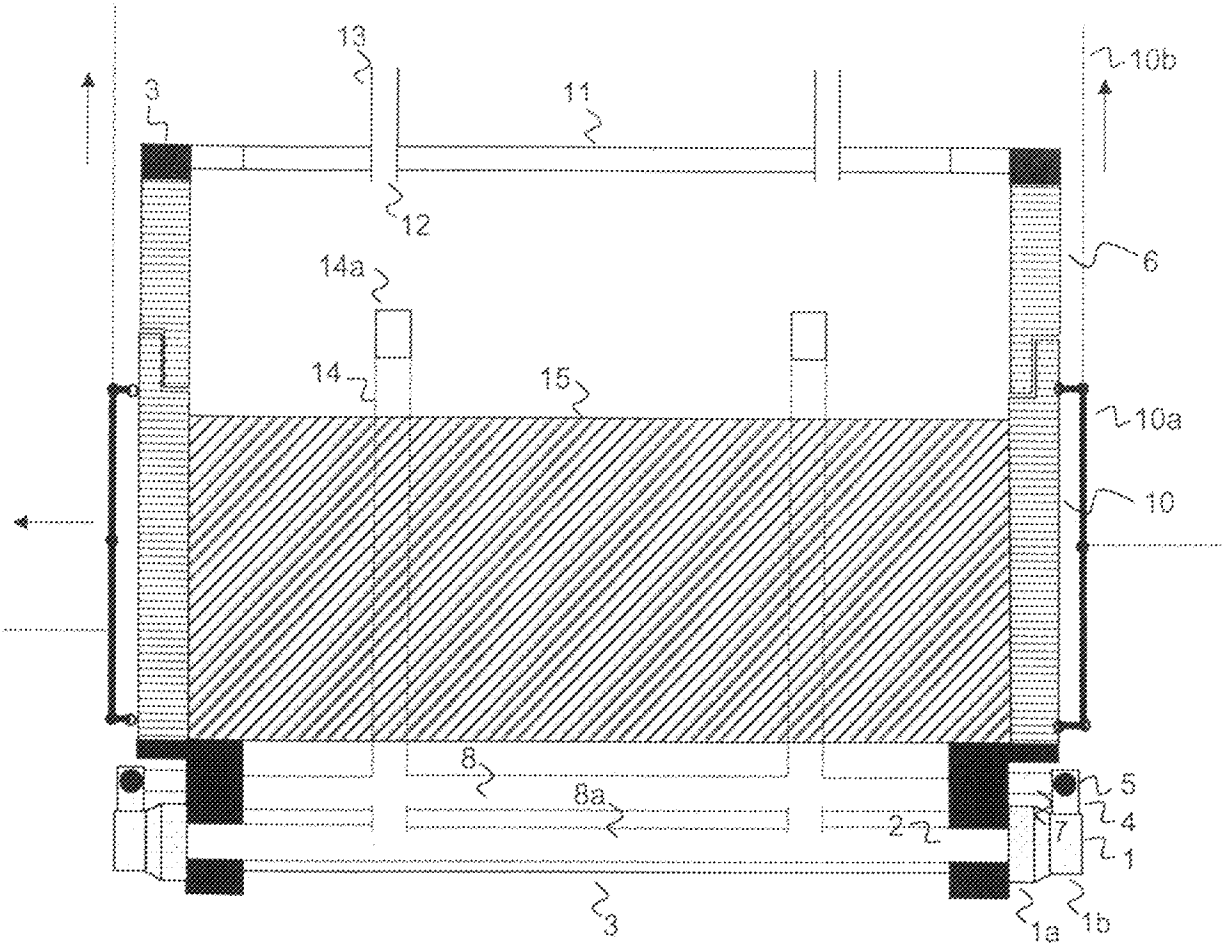
FIG. 4 shows the lateral view of a coke oven chamber with the inventive device which is mounted at the secondary air apertures beneath the coke oven chamber doors.

FIG. 4 shows the inventive parallelepiped attachments (1) or plates which are shown here with a front-end major cuboid (1*a*) and a minor rear-end cuboid (1*b*). These are connected to each other via a backwardly tapering section. The parallelepiped attachments (1) are upwardly linked to a connecting web (4) which in turn is linked to a thrust bar (5). The connecting rod (5) in turn is fastened via a fixing device (7) to the coke oven chamber wall. The secondary air soles (8) are located behind the apertures for admittance of secondary air (2). To be seen here, too, are the "downcomer" pipes (14), the associated apertures in the primary combustion space (14*a*) and the coke cake (15).

Figure 5:
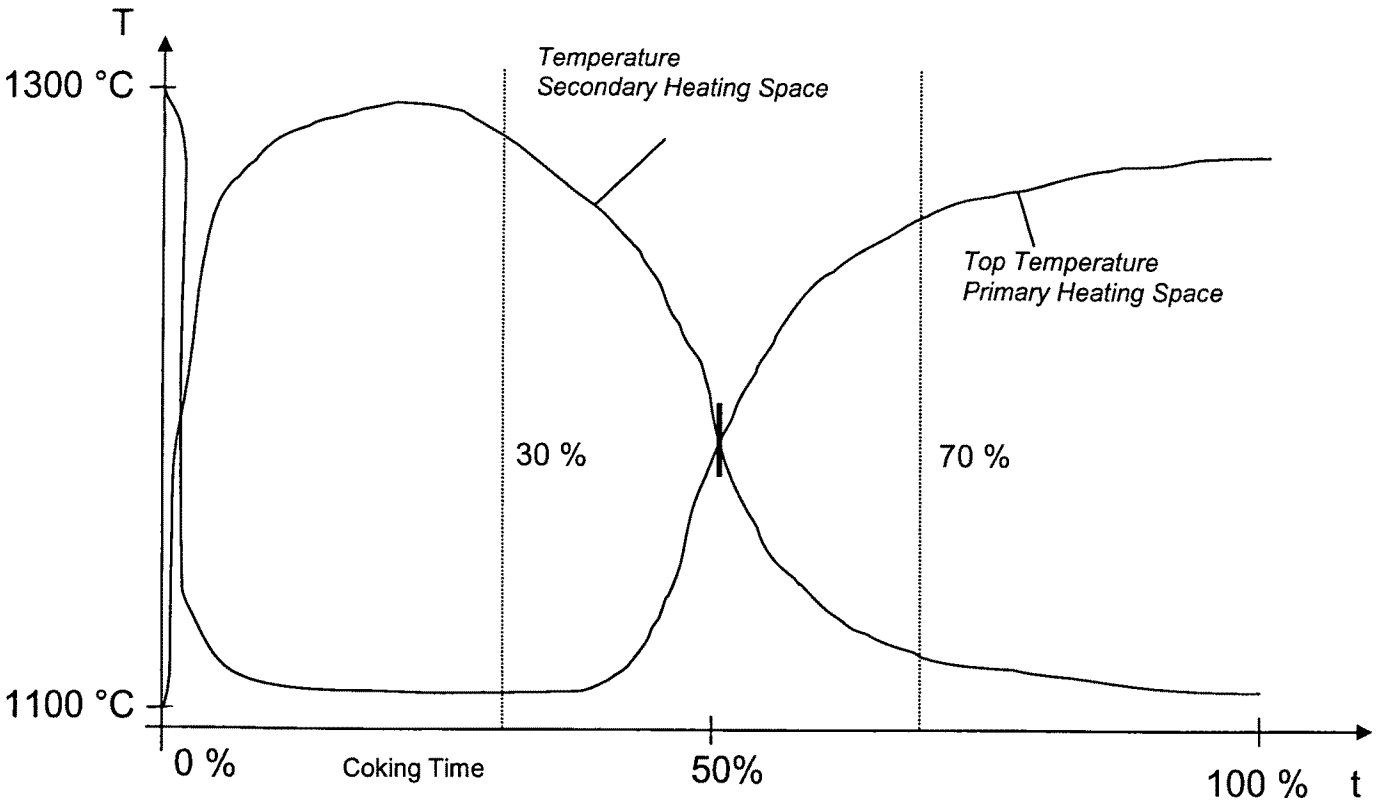
FIG. 5 shows a typical course of temperatures in the primary and secondary heating chamber of a coke oven chamber on applying the inventive method.

FIG. 5 illustrates a typical course of temperatures in the primary heating space and in the secondary air sole. At the beginning of the coking cycle, the temporal duration of which is shown on the abscissa in a range from 0 to 100 percent of time, the temperature in the secondary heating space rises due to the beginning of coking gas combustion. Accordingly, the coke cake is heated from below. Conversely, the temperature in the primary heating space falls due to the initiation of coal carbonization and due to the degassing of volatile matter. Not until the end of coal carbonization may the temperature in the primary heating space rise, so that the coke cake is also heated from above. Conversely, the secondary air apertures are slowly closed because combustion of partly burnt coking gas slows down and cool combustion air enters. By way of this temperature course, the coke cake can be heated optimally from all sides. To ensure such an ideal course of temperature, the parallelepiped attachments of the secondary air apertures are moved in a precisely controlled manner. For the case illustrated here, for example, it means slowly closing the secondary air apertures by a lateral movement of the parallelepiped attachments towards the secondary air apertures for closing, commencing at a coking time of 30 to 70 percent of the coking cycle. The movement of the parallelepiped attachments to close the secondary air apertures may be effected gradually step by step, too, depending on requirements. Temperatures achieved here, for example, range between 1100° C. and 1300° C.

LIST OF REFERENCE SYMBOLS

1 Parallelepiped attachments
1*a* Front-end cuboid
1*b* Rear-end cuboid
2 Secondary air apertures
3 Coke oven chamber
4 Connecting web
5 Thrust bar
6 Coke oven chamber wall
7 Fixing devices
8 Secondary heating space
8*a* Secondary air sole
9 Positioning motor
9*a* Drive piston for thrust bar
9*b* Pressure cylinder for positioning motor
9*c* Delivery mains for gas or liquid
10 Coke oven chamber door
10*a* Coke oven chamber door fixing

10*b* Coke oven chamber door hoisting device
11 Coke oven chamber ceiling
12 Entry apertures for primary air
13 U-tube shaped covers
13*a* Tubes with flaps as covers
14 "Downcomer" tubes
14*a* Apertures of "Downcomer" tubes in the primary heating space
15 Coke cake

The invention claimed is:

1. A method for proportioning of secondary combustion air into the secondary air sole of coke oven chambers of a coke oven battery or a coke oven bank, comprising:

feeding secondary combustion air through secondary air apertures in a frontal coke oven chamber wall in the lower area of the coke oven chamber beneath a coke oven chamber door into a secondary air sole and then streaming the air into a secondary heating space located there above; and partly burning coking gas in the upper area of the coke oven chamber and is and then completely burning the coking gas, with the completely burnt coking gas being conducted through the entire secondary heating space so that the coke cake is additionally heated from the lower side; wherein the secondary air aperture is covered by a parallelepiped attachment linked via a con-rod to a thrust bar so that the parallelepiped attachment opens or closes the secondary air aperture with its front-end side at each position along the coke oven chamber wall while the thrust bar is moved longitudinally along the frontal coke oven chamber so that the secondary air quantity admitted into the secondary air sole can be proportioned; and the thrust bar can be traversed via connecting webs through a positioning motor or manually so that the secondary air quantity admitted into the secondary air sole is proportioned as this thrust movement is made.

2. The method according to claim 1, wherein the thrust bar is pneumatically driven via the positioning motor.

3. The method according to claim 1, wherein the thrust bar is hydraulically driven via the positioning motor.

4. The method according to claim 1, wherein the thrust bar or connecting webs or the parallelepiped attachments comprise optical or electrical monitoring instruments through which the position of the parallelepiped attachments can be indicated and monitored.

5. The method according to claim 1, wherein each coke oven of the coke oven battery has a second frontal side, and the secondary air apertures of only one coke oven of a coke oven battery are jointly controlled at both frontal sides.

6. The method according to claim 1, wherein each coke oven of the coke oven battery has a second frontal side, and each secondary air aperture of only one coke oven of a coke oven battery is individually controlled at both frontal sides.

7. The method according to claim 5, wherein each coke oven of the coke oven battery has a second frontal side, and the secondary air apertures of one coke oven of a coke oven battery at only one frontal side are controlled jointly or individually.

8. The method according to claim 1, wherein the proportioning of secondary air is controlled via the positioning motor through the temperature in the coke oven chamber, said temperature being determined by temperature sensors in the gas space of the primary heating space and of the secondary heating space.

9. The method according to claim 8, wherein the temperatures in the primary heating space and in the secondary heating space are 1000 to 1400° C.

10. The method according to claim 8, wherein the closing of the secondary air apertures through the parallelepiped attachments commences at a coking time of 30 to 70 percent of the total time of the coking cycle.

11. The method according to claim 10, wherein the closing of the secondary air apertures through the parallelepiped attachments commences at a temperature difference of the measured temperature in the primary heating space and the measured temperature in the secondary heating space of less than 100° C.

12. The method according to claim 1, wherein the proportioning of secondary air is controlled via the positioning motor through the content of oxygen in the secondary air heating space, said oxygen content being determined by a Lambda probe in the secondary heating space.

13. A device for proportioning the secondary combustion air into the secondary air sole of coke oven chambers of a coke oven battery or a coke oven bank, wherein:

a plurality of apertures in a frontal coke oven chamber wall beneath a coke oven chamber door are provided for entry of secondary combustion air into a plurality of channels positioned beneath a coking chamber, wherein a partly burnt coking gas is mixed with a secondary combustion air and burnt completely, so that a coke cake is heated from below by the combustion of the partly burnt coking gas;

a plurality of parallelepiped attachments are provided on the front side of the apertures, the parallelepiped attachments having a cuboid side away from the oven, which on the cuboid side away from the oven are linked to a second smaller cuboid;

a con-rod or a connecting web through which the second cuboid is linked to a thrust bar is mounted on the upper side of the second smaller cuboid;

the thrust bar can be traversed through a positioning motor or manually in parallel to the frontal coke oven chamber wall; and the thrust bar is movable longitudinally along the coke oven chamber wall, and when moved, moves the parallelepiped attachments by the longitudinal movement along the apertures so that these open or close the apertures depending on the position of the parallelepiped attachments.

14. The device for proportioning the secondary combustion air into the secondary air sole of coke oven chambers of a coke oven battery or a coke oven bank according to claim 13, wherein the cuboid side away from the oven is connected with the second smaller cuboid by a parallelepiped-shaped section tapering towards the second smaller cuboid.

15. The device according to claim 13, wherein the parallelepiped attachment facing the oven is a plate.

16. The device according to claim 13, wherein the cuboid side away from the oven or the plate for closure of secondary air apertures are made of high-heat resistant steel.

17. The device according to claim 13, wherein the thrust bar is linked via cardan joints to the con-rods or connecting webs and thus to a positioning motor.

18. The device according to claim 17, wherein the positioning motor for the thrust bar is comprised of a pressure cylinder and a driving piston contained therein for the thrust bar, the driving piston being configured to be movable by a liquid or a gas under pressure.

19. The device according to claim 18, wherein a protective mat or a protective shield is provided between the pressure cylinder and the connecting web to protect the positioning motor and the driving piston for the thrust bar from high temperatures.

20. The device according to claim 13 wherein the device is configured for use in a non-recovery coke oven battery or a coke oven bank.

21. The device according to claim 13 wherein the device is configured for use in heat-recovery coke oven battery or a coke oven bank.

* * * * *